US010137726B2

(12) United States Patent
Murrow

(10) Patent No.: US 10,137,726 B2
(45) Date of Patent: Nov. 27, 2018

(54) UPRIGHT MULTI-POSITION FABRIC PAINTING RACK

(71) Applicant: David Murrow, Chugiak, AK (US)

(72) Inventor: David Murrow, Chugiak, AK (US)

( * ) Notice: Subject to any disclaimer, the term of this patent is extended or adjusted under 35 U.S.C. 154(b) by 0 days.

(21) Appl. No.: 15/227,567

(22) Filed: Aug. 3, 2016

(65) Prior Publication Data

US 2018/0037053 A1 Feb. 8, 2018

(51) Int. Cl.
*B44D 3/18* (2006.01)
*B44D 3/22* (2006.01)

(52) U.S. Cl.
CPC ..... *B44D 3/185* (2013.01); *B44D 3/22* (2013.01)

(58) Field of Classification Search
CPC ..... B44D 3/18; B44D 3/185; A47B 97/04; A47B 97/08
USPC ..... 38/102–102.91
See application file for complete search history.

(56) References Cited

U.S. PATENT DOCUMENTS 463,303 A * 11/1891 Dippry ..... B44D 3/185 38/102.91
540,783 A * 6/1895 Eno ..... B44D 3/185 38/102.91
739,886 A * 9/1903 Loge et al. ..... B44D 3/185 108/115
977,210 A * 11/1910 Metcalfe ..... B44D 3/185 38/102.91
2,603,272 A * 7/1952 Rowand ..... A63G 9/12 248/163.2
3,805,966 A * 4/1974 Wakeman ..... A47F 5/13 211/175
4,129,916 A * 12/1978 Schlesinger ..... A63C 19/10 14/69.5
4,441,267 A * 4/1984 Doss ..... C14B 1/26 24/27
4,714,224 A * 12/1987 Calmes ..... A47B 97/08 108/10
4,934,015 A * 6/1990 Mink ..... A47L 4/04 15/268
5,016,893 A * 5/1991 Hart, Jr. ..... B62B 3/10 211/195
5,056,247 A * 10/1991 Loomie ..... B44D 3/185 38/102.1

(Continued)

*Primary Examiner* — Tyrone V Hall, Jr.
(74) *Attorney, Agent, or Firm* — C. John Brannon; Brannon Sowers & Cracraft PC

(57) ABSTRACT

A painting rack assembly, including a frame portion having a first pair of spaced, parallel elongated members, a second pair of spaced, parallel semi-elongated members connected to the first pair of spaced, parallel elongated members to define a parallelogram further defining a working plane, a respective centered pivotable connector operationally connected to each respective semi-elongated member, and a plurality of fabric connection assemblies operationally connected to and distributed around the parallelogram, and a support assembly operationally connected to the frame portion having a pair of elongated support members, each respective elongated support member connected to a respective pivotable connector at one end and having a connection socket at the other, oppositely disposed end, and a pair of spaced elongated stabilizing members extending orthogonally from each respective elongated support member and oriented parallel to the working plane.

9 Claims, 7 Drawing Sheets

(56) References Cited

U.S. PATENT DOCUMENTS

| | | | | |
|---|---|---|---|---|
| 5,377,849 | A * | 1/1995 | Martin | A47F 8/02 211/182 |
| 5,520,293 | A * | 5/1996 | Hartley | A47B 47/04 211/182 |
| 5,617,962 | A * | 4/1997 | Chen | A47G 25/0664 211/204 |
| 5,660,637 | A * | 8/1997 | Dodge | B05B 13/0285 118/500 |
| 5,870,840 | A * | 2/1999 | Geils | D05C 1/02 38/102.21 |
| 5,938,203 | A * | 8/1999 | Beckwith, Sr. | F41J 1/10 273/407 |
| 6,209,240 | B1 * | 4/2001 | Engle | D05C 1/02 38/102.21 |
| 6,435,512 | B1 * | 8/2002 | Beckwith, Sr. | F41J 1/10 273/403 |
| 7,278,621 | B1 * | 10/2007 | Bareis | A47B 97/04 248/441.1 |
| 8,783,473 | B1 * | 7/2014 | Schosek | A47G 25/0664 211/198 |
| 2004/0020887 | A1 * | 2/2004 | Jersey | A47B 45/00 211/189 |
| 2010/0162602 | A1 * | 7/2010 | Da Ponte Moreira Rato | B44D 3/185 40/711 |

* cited by examiner

UPRIGHT MULTI-POSITION FABRIC PAINTING RACK

TECHNICAL FIELD OF THE INVENTION

The present invention relates generally to mechanical arts, and, more particularly, to an adjustable rack for supporting a scarf or like fabric swath vertically, inverted vertically, and horizontally during the painting process.

BACKGROUND OF THE INVENTION

There is a solid and growing subculture devoted to the textile arts in general, and scarf painting in particular. Typically, scarves are painted by stretching the silk or like fabric on a horizontal rack and painting, wetting the scarf with water or a water-alcohol blend, and painting the scarf by hand with brushes. While fine painted scarves may be produced in this manner, the technique suffers from some drawbacks. For example, paint tends to pool on the surface of the stretched fabric. Further, those painters having limited range of motion or joint issues may find it difficult to access the entirety of the scarf.

Further, less experienced artists find paint blending more difficult when limited to a horizontal orientation, and painting a horizontal surface tends to be more tiring, especially for older artists, as the artist must remain hunched over the fabric for extended periods of time.

Thus, there remains a need for an improved rack assembly that may makes scarf painting easier for artists of all skills and abilities. The present invention addresses this need.

DETAILED DESCRIPTION OF THE PREFERRED EMBODIMENTS

Figure 1:
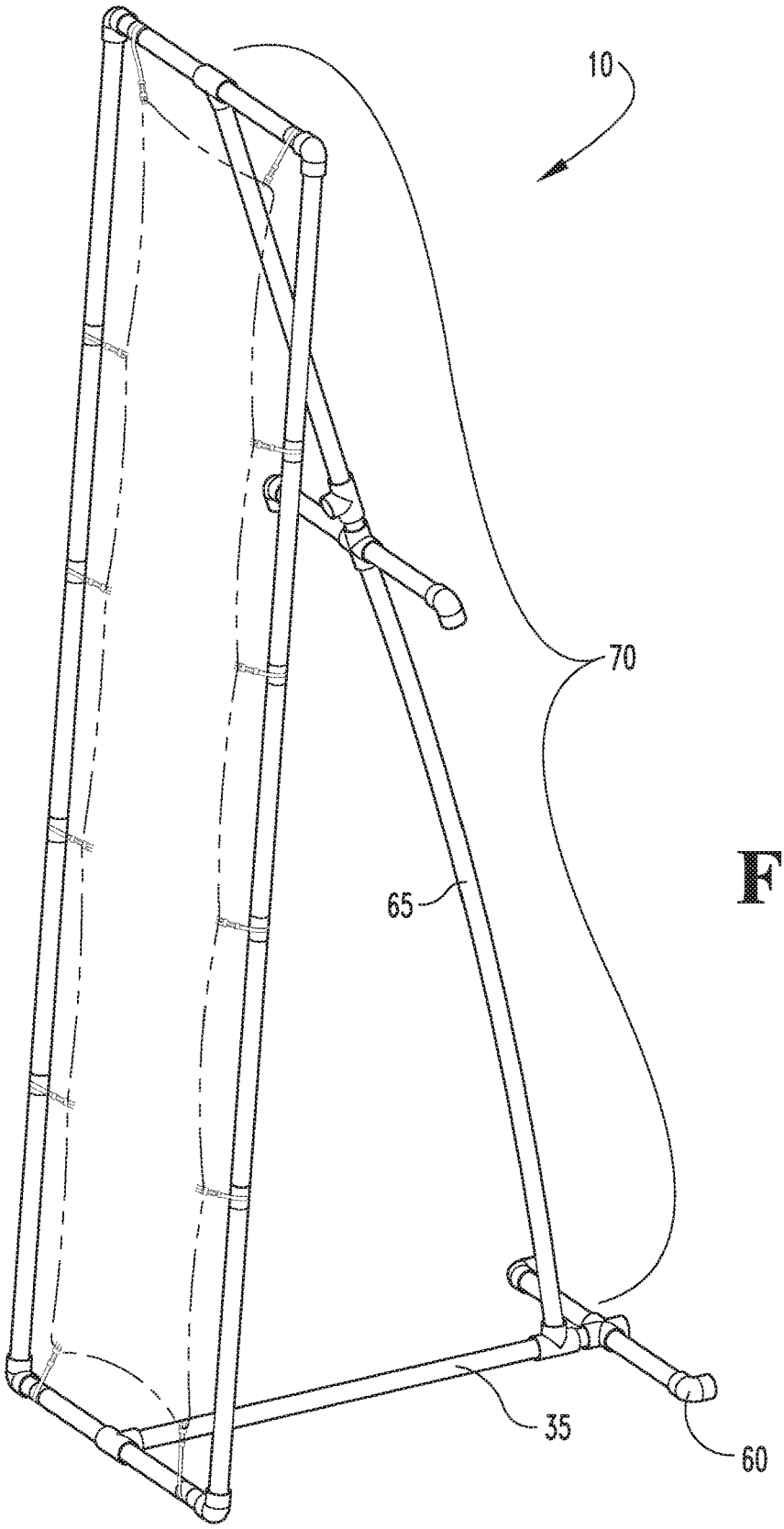
FIG. 1 is a first front perspective view of a first embodiment scarf painting rack assembly of the present invention.

For the purposes of promoting an understanding of the principles of the invention and presenting its currently understood best mode of operation, reference will now be made to the embodiments illustrated in the drawings and specific language will be used to describe the same. It will nevertheless be understood that no limitation of the scope of the invention is thereby intended, with such alterations and further modifications in the illustrated device and such further applications of the principles of the invention as illustrated therein being contemplated as would normally occur to one skilled in the art to which the invention relates.

Figure 2:
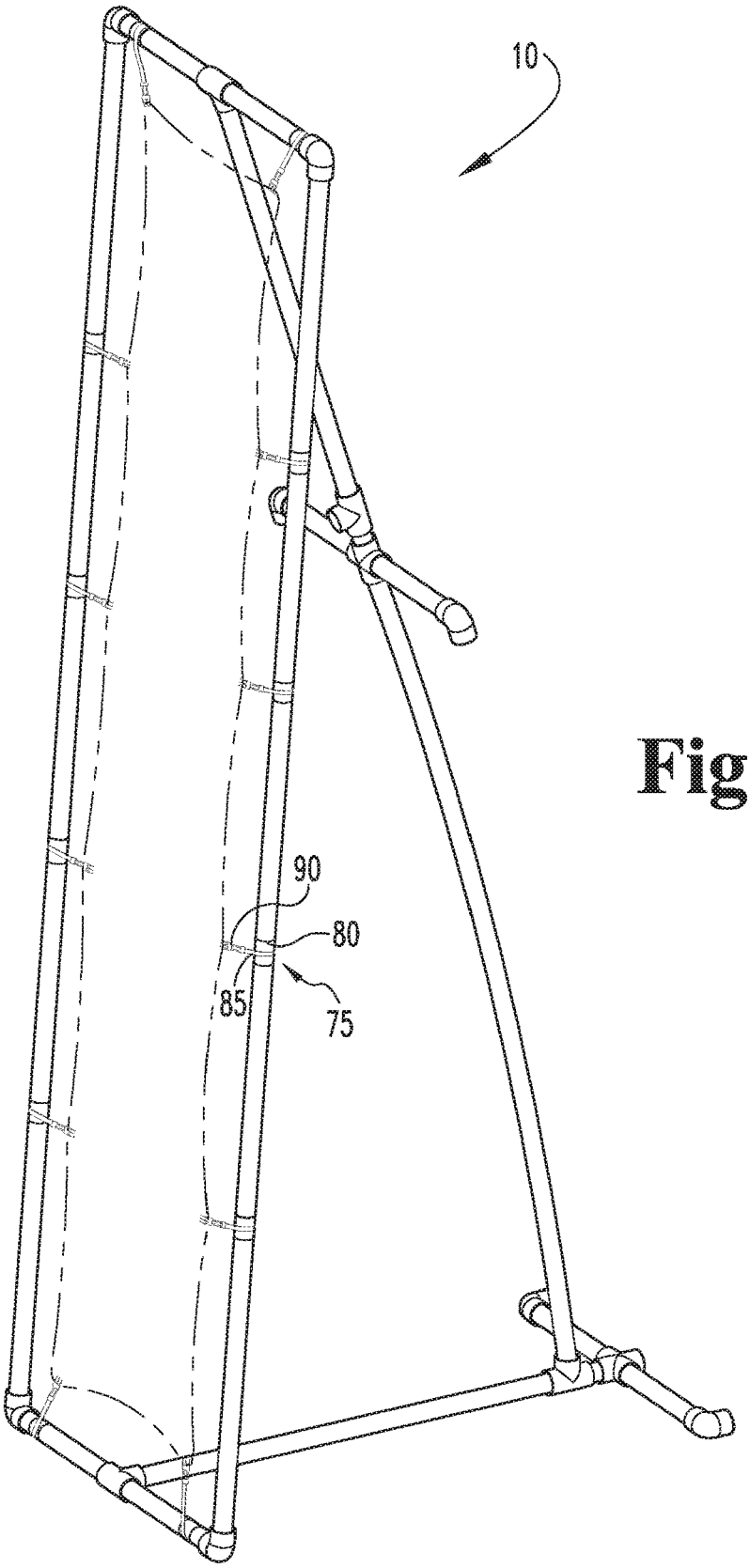
FIG. 2 is a second, inverted front perspective view of the embodiment of FIG. 1 as configured for inverted support.
Figure 3:
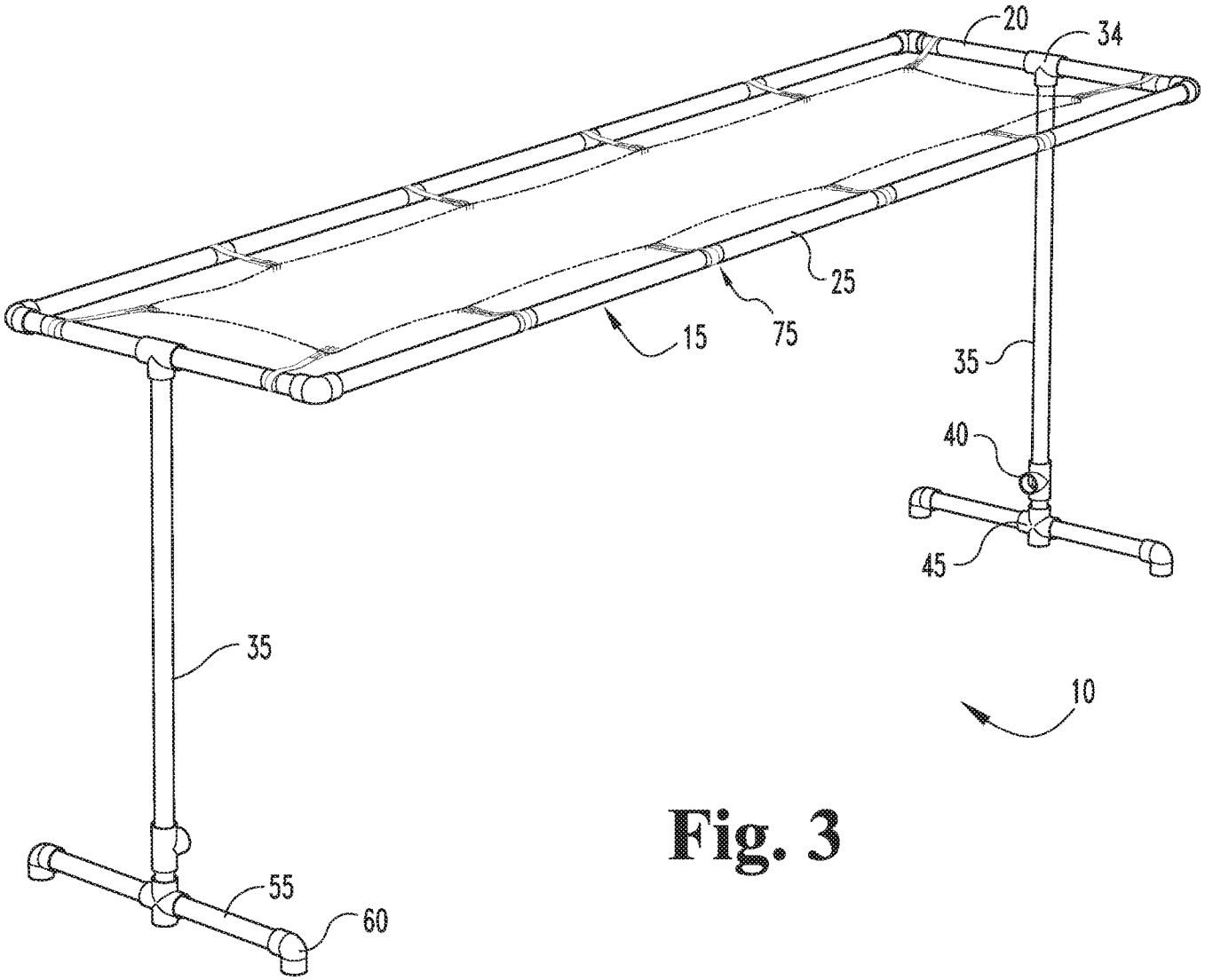
FIG. 3 is a third front perspective view of the embodiment of FIG. 1 as configured for horizontal support.
Figure 4:
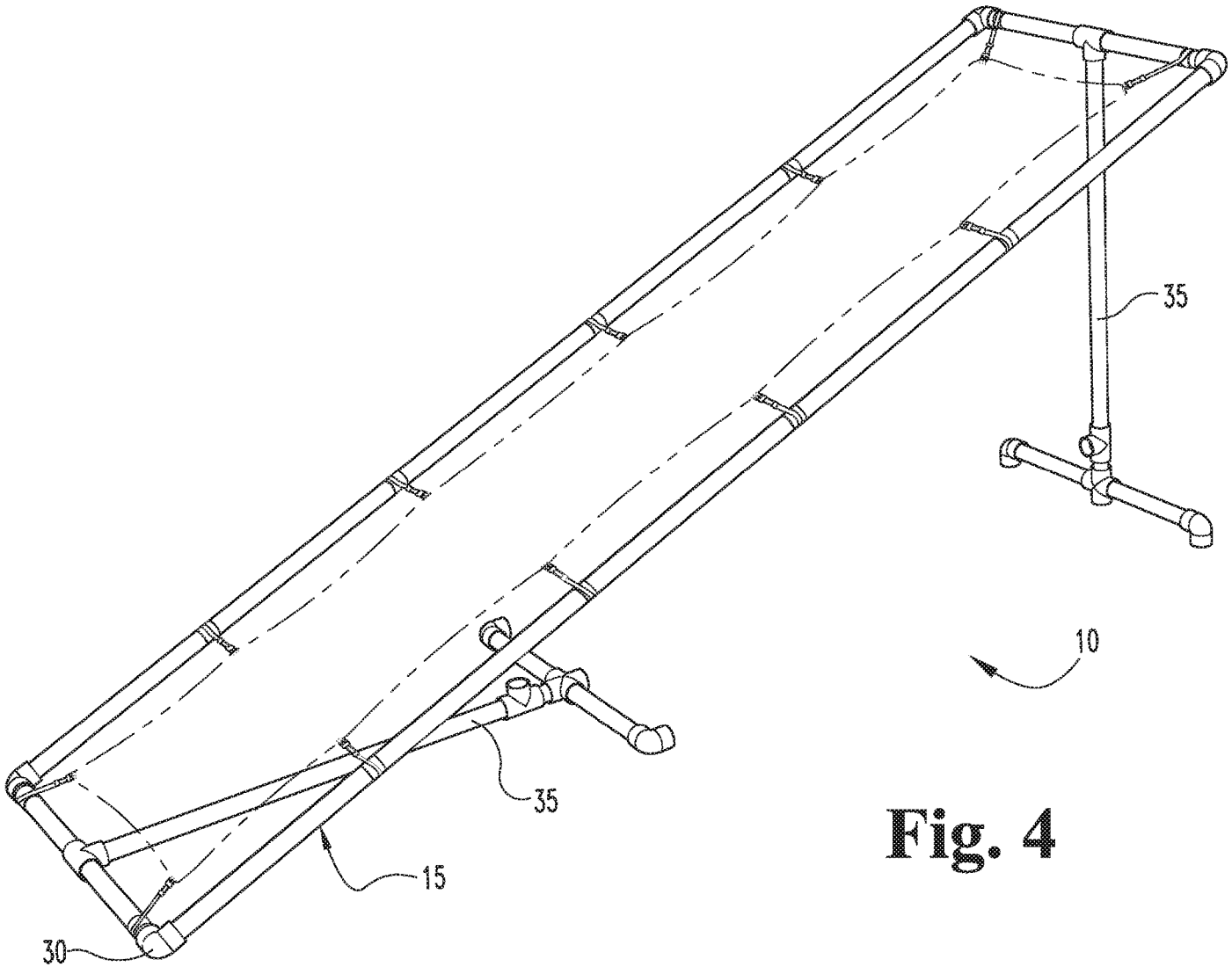
FIG. 4 is a fourth front perspective view of the embodiment of FIG. 1 as configured for diagonal support.
Figure 5:
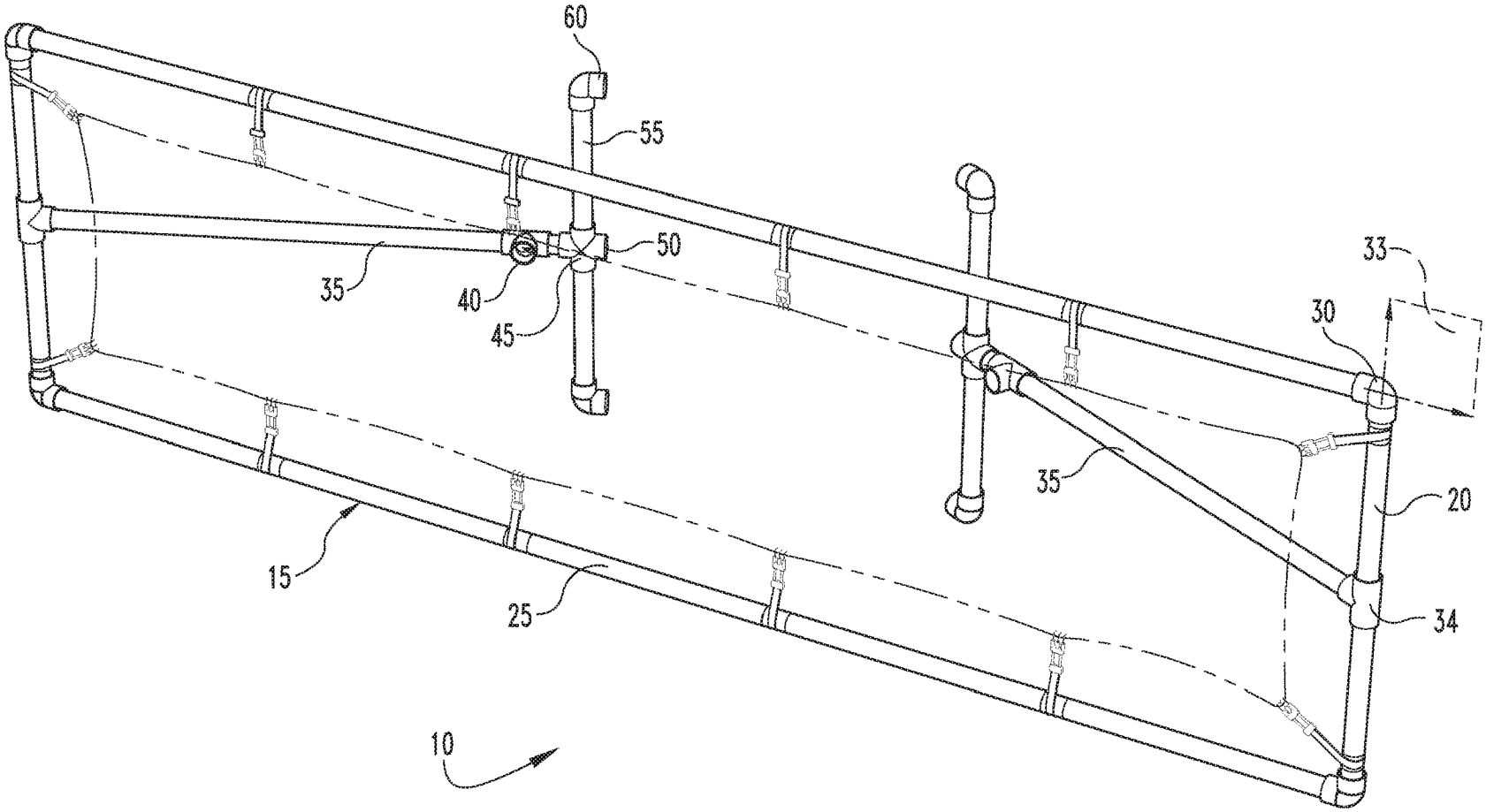
FIG. 5 is a fifth front perspective view of the embodiment of FIG. 1 as configured for side support.
Figure 6:
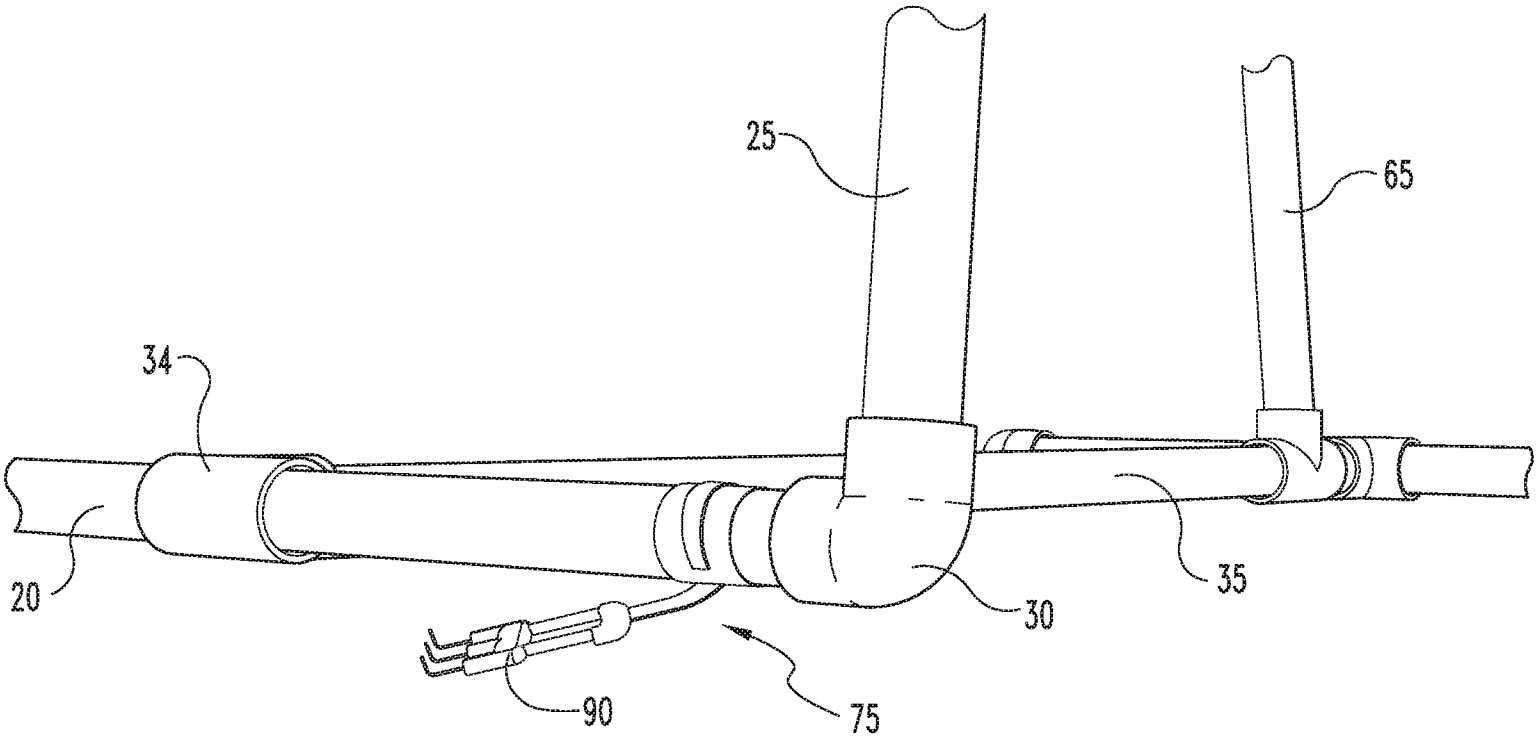
FIG. 6 is an enlarged partial perspective view of the embodiment of FIG. 1 showing the support base.
Figure 7:
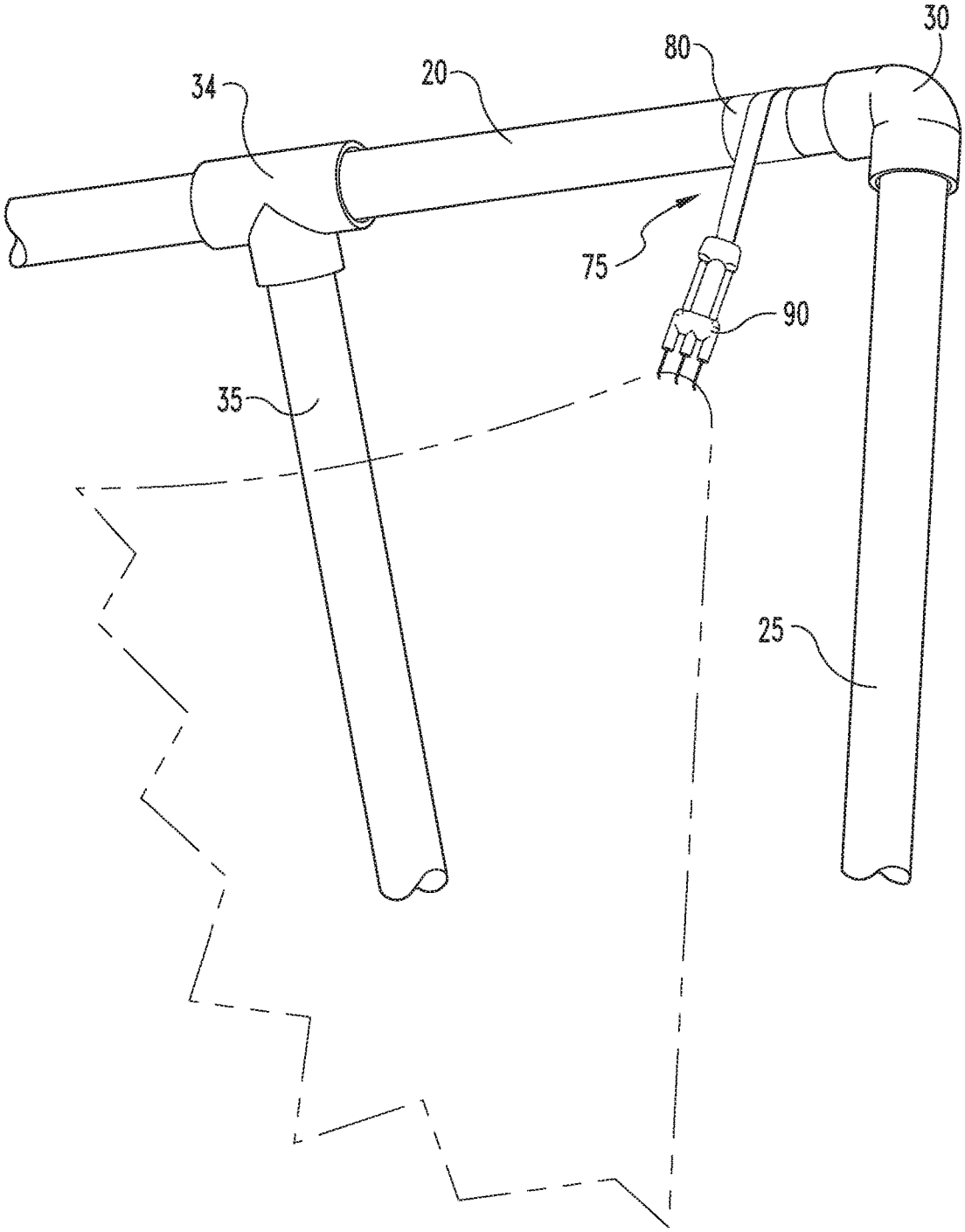
FIG. 7 is an enlarged partial perspective view of the embodiment of FIG. 1 showing a tensioning assembly.

FIGS. 1-7 relate to a first embodiment of the present invention, a painting rack system or assembly 10 for supporting a scarf or like fabric or textile item, including a generally rectangular elongated frame 15 defined by a first pair of elongated spaced parallel disposed members 20 and a second pair of elongated spaced parallel disposed members 25, wherein the first elongated members 20 are of a first length and the second elongated members 25 are of a second length at least equal to the first length and typically substantially greater than the first length (when the elongated member 20 is shorter than elongated member 25, it may be conveniently referred to as a 'semi-elongated' member 20). While scarves are specifically mentioned herein by way of example, it is noted that the assembly 10 may likewise support any convenient fabric or textile item. Each member 20, 25 is connected at either end to a respective member 25, 20, with the intersections of members 20, 25 defining an angle of about 90 degrees. In some embodiments, members 20, 25 intersect at an elbow joint 30 operationally connected thereto. The generally rectangular frame 15 defines a first working plane 33. In some embodiments, the generally rectangular frame 15 is jointed or coupled for folding in half for ease of transport and storage.

Respective elongated members 20 typically include pivotable joint 34 positioned along the length of the member 20, and more typically centered relative the ends of the member 20. The pivotable joint is typically a T-connector or the like and is able to pivot or even rotate relative to the member 20. The proximal end of a respective pivotable elongated support member 35 is connected to and extends from each respective pivotable joint 34. The distal end of the elongated support member 35 includes a joint, socket or connector 40 facing the working plane 33 and a four-way connector 45 connected to the distal end, into which the distal end is typically inserted. The connector 45 includes a connection joint or socket 50 disposed opposite the distal end, and pair of spaced elongated stabilizing members 55 extending therefrom and disposed perpendicularly to the elongated member 35 and parallel to the working plane 33. Each stabilizing member 55 typically terminates in a foot 60, which may be an elbow joint or the like.

An elongated utility member 65 is typically insertable into the socket connection 40 of one respective member 35 (which extends perpendicularly away from the working plane 33) and into the socket 50 of the opposite member 35 to define an elongated 'hypotenuse' member 70. The hypotenuse member 70 and the opposite elongated member 35 define a first vertical orientation of the system 10. By disengaging the utility member 65 from the respective first sockets 40, 50 and reengaging the utility member 65 with the respective opposite sockets 40, 50, a second flipped or inverted vertical orientation of the system 10 is defined, allowing the frame 15 to be rotated one hundred and eighty degrees.

In some embodiments, an elongated utility member 65 is telescopingly connected to one or both elongated support members 35, such that it may be extended therefrom when needed and retracted thereinto when not in use. In these embodiments, disengaging the utility member 65 is accomplished by retracting it into the support member 35 to which it is connected. In other embodiments, the utility member 65 is at least partially magnetic and is magnetically attachable to the respective members 35, which likewise are either partially magnetic or ferromagnetic. In still other embodiments, the utility member 65 is jointed for folding.

The utility member 65 may be disengaged from the elongated members 35 and set aside, and the elongated members 35 may both be pivoted to an orientation perpendicular to the working plane 33 and the elongated members 20, 25 to define a third, horizontal orientation of the frame 15. Further, one of the elongated members 35 may be pivoted toward the working plane 33 to define a fourth 'horizontal tilted' orientation of the system 10, with the working plane 33 defining an acute angle with the ground or other flat horizontal surface upon which the system may be placed. Finally, the elongated members 35 may be positioned to extend away from the frame 15 and the frame may be rotated such that one of the elongated members 25 rests on the ground or floor such that the working plane 33 is oriented generally or substantially perpendicular to the ground or floor to define a fifth orientation of the system 10.

The elongated members 20, 25, 35, 55 and other components 34, 40, 45, 50, 60 are typically made of PVC piping, but may likewise be made of any convenient structural material.

Material connection assemblies 75 are positioned at spaced intervals along the elongated members 20, 25 for connecting to and stretching silk scarves to hold them taught in the frame 15 during the painting process. Each respective connection assembly 75 typically includes a connector 80 for attaching to a respective member 20, 25 (typically a hook and loop type flexible connection strip), an elastic member 85 connected to and extending from the connection strip 80, and a scarf-engaging member 90 (such as a suspension hook) connected to the elastic member 85. The engaging member 90 is typically three-fingered. The attachment assemblies 75 are typically tension-adjustable, allowing the tension upon the connected scarf or fabric swath to be varied as desired or necessary during the painting process.

In operation, a scarf is engaged with the frame 15 by connection to the plurality of attachment assemblies 75. The scarf is typically stretched taught in the working plane 33 by the connection assemblies 75. The system 10 then configured for the first vertical position as described above, the utility member 65 connected to the socket 50 of a first elongated member 35 and the socket 40 of a second respective elongated member 35. The frame 15 is oriented to rest on the second elongated member 35, which extends generally perpendicularly away from the working plane 33. The scarf is then partially painted. Painting is typically done 'wet', with water or a water/alcohol blend or the like sprayed onto the scarf to facilitate painting.

The utility member 65 is then disengaged from the elongated respective members 35 and then reengaged to each member 35, engaging the socket 40 of the member 35 previously engaged with socket 50 and engaging socket 50 of the member 35 previously engaged with socket 40. The frame 15 is then rotated one hundred and eighty degrees to rest on the opposite member 35. Painting is resumed with the system in the second orientation, allowing the paint and fluids to flow in the opposite direction to 'blend' the paint slightly as well as to allow mobility impaired painters to paint the entire scarf without having to kneel or otherwise contort themselves.

The utility member 65 is then removed and the system 10 is then put into the third, horizontal orientation. Further painting may be done without the blending effect of the vertical orientations, and texturing treatments, such as salting, may be done.

The system 10 may then be put into the fourth, tilted orientation to allow the formation of 'rivulets'.

Optionally, the system 10 may be put into the fifth orientation, either after the fourth orientation or immediately after the third orientation, to facilitate the flowing of the paint in the 'sideways' direction, i.e., in the direction from one elongated member 25 to the opposite elongated member 25.

Once the scarf has dried, it is removed from the frame 15 by disengaging the connectors 75.

The ability to place the rack system 10 into multiple orientations during the painting process allows the painter control over when, and to what extent, paint blending occurs, control over direction of paint blending, and control over the rate of drying of the painted item, as well as enhancing the even drying of the painted item, reducing painter fatigue, and increasing access of painting to artists of varying sizes and physical abilities. When painting on racks 10 in the upright position, artists may more readily socialize with one another during the painting process.

While the invention has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the invention are desired to be protected.

The invention claimed is:

1. A painting rack assembly for supporting fabric during a painting process, comprising:

a frame portion, further comprising:

a first pair of spaced, parallel elongated members;

a second pair of spaced, parallel semi-elongated members connected to the first pair of spaced, parallel elongated members to define a parallelogram, wherein the parallelogram further defines a working plane within which a scarf may be taughtly stretched;

a respective pivotable connector operationally connected to each respective semi-elongated member, wherein each respective pivotable connector is centered relative each respective semi-elongated member; and a plurality of independently tension-adjustable partially elastic fabric connection assemblies operationally connected to and distributed around the parallelogram; and a support assembly operationally connected to the frame portion, further comprising:

a pair of elongated support members, each respective elongated support member connected to the respective pivotable connector at one end and having a connection socket at the other, oppositely disposed end;

a pair of spaced elongated stabilizing members extending orthogonally from each respective elongated support member and oriented parallel to the working plane:

a respective four-way connector operationally connected to each respective support member; and an elongated utility member magnetically connected at a first one end to the connection socket attached to one of the pair of elongated support members and magnetically connected at a second, opposite end to the four-way connector connected to another one of the pair of elongated support members;

wherein the four-way connector is operationally connected to each respective spaced stabilizing member.

2. The assembly of claim 1 and further comprising at least one foot member operationally connected to each respective stabilizing member.

3. The assembly of claim 1 wherein the elongated utility member is retractably connected to one respective elongated support member and extending to the other respective elongated support member.

4. An orientation-adjustable rack assembly for supporting a scarf for painting, comprising:

a plurality of spaced elongated members connected contiguously together to define a frame, wherein the frame defines a working plane;

a first respective pivotable connector operationally connected to a first respective elongated member;

a second respective pivotable connector operationally connected to a second, spaced elongated member;

a plurality of three-fingered, partially elastic fabric tensioners operationally connected to, and distributed around, the frame; and a pair of elongated magnetically engageable support members, each respective elongated magnetically engageable support member connected to the respective first and second pivotable connector; and a pair of spaced elongated stabilizing members extending orthogonally from each respective elongated support member and oriented parallel to the working plane; and an elongated magnetic utility member connectable to one respective elongated magnetically engageable support member and connectable to the other respective elongated magnetically engageable support member to extend therebetween;

wherein the elongated magnetic utility member is connectable in an orientation parallel to the working plane between one respective magnetically engageable support member and the other respective magnetically engageable support member when the respective magnetically engageable support members are oriented parallel to one another such that the working plane may be oriented in a generally horizontal disposition; and wherein the elongated magnetic utility member is connectable in an orientation nonparallel to the working plane between one respective magnetically engageable support member and the other respective magnetically engageable support member when the respective magnetically engageable support members are pivoted toward one another such that the working plane may be oriented in a generally vertical disposition.

5. The assembly of claim 4 wherein the elongated utility member is detachably connected to one respective elongated support member and detachably connected to the other respective elongated support member.

6. The assembly of claim 4 wherein the respective spaced elongated members, elongated magnetically engageable support members, elongated stabilizing members, and elongated magnetic utility members are PVC pipes; wherein the elongated magnetic utility member further comprises a magnetic portion;

and wherein the elongated magnetically engageable support members each further comprise a magnetically engageable portion.

7. A kit for constructing an orientation-adjustable rack assembly for supporting a scarf for painting, comprising:

a plurality of elongated frame members connectable to yield a frame defining a working plane;

a plurality of fabric tensioners operationally connectable to respective elongated frame members;

a pair of elongated support members, each respective elongated support member connectable to a respective pivotable connector; and a plurality of elongated stabilizing members connectable to extend orthogonally from each respective elongated support member and oriented parallel to the working plane; and an at least partially magnetic utility member for magnetic connection between the respective elongated support members;

wherein at least two respective elongated members each have the respective pivotable connector operationally connected thereto;

wherein the utility member is connectable in an orientation parallel to the working plane between one support member and the other respective support member when the respective support members are oriented parallel to one another such that the frame may be oriented in a generally horizontal disposition; and wherein the utility member is connectable in an orientation nonparallel to the working plane between one support member and the other respective support member when the respective support members are pivoted toward one another such that the frame may be oriented in a generally vertical disposition.

8. The kit of claim 7 wherein the utility member is retractably extendable from one support member to the other respective support member.

9. The kit of claim 7 wherein the plurality of elongated frame members comprise a first set of frame members comprising a first length and a second set of frame members comprising a second length, wherein the first length is different from the second length.

* * * * *